US007856872B2

(12) United States Patent
Irani et al.

(10) Patent No.: US 7,856,872 B2
(45) **Date of Patent: *Dec. 28, 2010**

(54) SINGLE PHASE FLUID SAMPLING APPARATUS AND METHOD FOR USE OF SAME

(75) Inventors: Cyrus A. Irani, Houston, TX (US); Vincent P. Zeller, Flower Mound, TX (US); Charles M. MacPhail, Little Elm, TX (US); Scott Brown, Houston, TX (US); Timothy R. Carlson, Lisle, IL (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/483,578

(22) Filed: Jun. 12, 2009

(65) Prior Publication Data

US 2009/0241658 A1 Oct. 1, 2009

Related U.S. Application Data

(63) Continuation of application No. 11/438,764, filed on May 23, 2006, now Pat. No. 7,596,995, which is a continuation-in-part of application No. 11/268,311, filed on Nov. 7, 2005, now Pat. No. 7,197,923.

(51) Int. Cl.
*E21B 49/00* (2006.01)

(52) U.S. Cl. ..... 73/152.23

(58) Field of Classification Search ..... None
See application file for complete search history.

(56) References Cited

U.S. PATENT DOCUMENTS 3,611,799 A 10/1971 Davis
4,570,481 A 2/1986 McLaurin
4,665,983 A 5/1987 Ringgenberg
4,747,304 A 5/1988 King (Continued)

FOREIGN PATENT DOCUMENTS

EP 0 534 732 A1 3/1993

(Continued)

OTHER PUBLICATIONS

Competitor Product Update, Schlumberger DST Sampling Systems-SCAR (undated but admitted prior art).

(Continued)

*Primary Examiner*—Robert R Raevis
(74) *Attorney, Agent, or Firm*—Lawrence R. Youst

(57) ABSTRACT

An apparatus (100) for obtaining a plurality of fluid samples in a subterranean well includes a carrier (104), a plurality of sampling chambers (102) and a pressure source (108) of the apparatus (100). The carrier (104) has a longitudinally extending internal fluid passageway (112) providing a substantially smooth bore therethrough and a plurality of chamber receiving slots (159). Each of sampling chamber (102) is positioned in one of the chamber receiving slots (159) of the carrier (104). The pressure source (108) is selectively in fluid communication with each of the sampling chambers (102) such that the pressure source (108) is operable to pressurize each of the sampling chambers (102) after the samples are obtained.

21 Claims, 8 Drawing Sheets

U.S. PATENT DOCUMENTS

| | | | | |
|---|---|---|---|---|
| 4,787,447 | A | 11/1988 | Christensen | |
| 4,878,538 | A | 11/1989 | Christensen | |
| 4,883,123 | A | 11/1989 | Zunkel et al. | |
| 4,903,765 | A | 2/1990 | Zunkel | |
| 5,058,674 | A | 10/1991 | Schultz et al. | |
| 5,230,244 | A | 7/1993 | Gilbert | |
| 5,240,072 | A | 8/1993 | Schultz et al. | |
| 5,329,811 | A | 7/1994 | Schultz et al. | |
| 5,687,791 | A | 11/1997 | Beck et al. | |
| 5,934,374 | A | 8/1999 | Hrametz et al. | |
| 6,065,355 | A | 5/2000 | Schultz | |
| 6,073,698 | A | 6/2000 | Schultz et al. | |
| 6,182,753 | B1 | 2/2001 | Schultz | |
| 6,182,757 | B1 | 2/2001 | Schultz | |
| 6,189,392 | B1 | 2/2001 | Schultz | |
| 6,192,984 | B1 | 2/2001 | Schultz | |
| 6,301,959 | B1 | 10/2001 | Hrametz et al. | |
| 6,439,307 | B1 | 8/2002 | Reinhardt | |
| 6,491,104 | B1 | 12/2002 | Wilie et al. | |
| 6,622,554 | B2 | 9/2003 | Manke et al. | |
| 7,090,012 | B2 | 8/2006 | Hill et al. | |
| 7,128,144 | B2 | 10/2006 | Fox et al. | |
| 7,197,923 | B1 | 4/2007 | Wright et al. | |
| 7,243,536 | B2 * | 7/2007 | Bolze et al. | 73/152.24 |
| 7,367,394 | B2 * | 5/2008 | Villareal et al. | 166/264 |
| 2002/0178804 | A1 | 12/2002 | Manke et al. | |
| 2003/0042021 | A1 | 3/2003 | Bolze et al. | |
| 2003/0066646 | A1 | 4/2003 | Shammai et al. | |
| 2004/0003657 | A1 | 1/2004 | Manke et al. | |
| 2004/0089448 | A1 | 5/2004 | DiFoggio | |
| 2004/0216874 | A1 | 11/2004 | Grant et al. | |
| 2005/0028973 | A1 | 2/2005 | Paluch et al. | |
| 2005/0155760 | A1 | 7/2005 | Hill et al. | |
| 2005/0205301 | A1 | 9/2005 | Irani et al. | |
| 2006/0000606 | A1 | 1/2006 | Fields et al. | |
| 2006/0101905 | A1 | 5/2006 | Bittleston et al. | |
| 2007/0101808 | A1 | 5/2007 | Irani et al. | |
| 2007/0193377 | A1 | 8/2007 | Irani et al. | |
| 2007/0240514 | A1 | 10/2007 | Irani et al. | |
| 2008/0148838 | A1 | 6/2008 | Irani et al. | |

FOREIGN PATENT DOCUMENTS

| | | | |
|---|---|---|---|
| GB | 2 348 222 | A | 9/2000 |
| WO | WO 01/63093 | A1 | 8/2001 |
| WO | WO 2004/099564 | A2 | 11/2004 |

OTHER PUBLICATIONS

Schlumberger, "PVT Express, Accurate, mobile fluid analysis service", Oct. 2005.
Schlumberger, "MDT Single-phase sampling", 2006.
OTC 18201, "Advances in Fluid Sampling with Formation Testers for Offshore Exploration", 2006.
Schlumberger MDT drawing, "Single Phase Multisample Chamber" (undated but admitted prior art).
EP International Search Report dated Aug. 29, 2007, International Application No. EP 07 252 099.

* cited by examiner

SINGLE PHASE FLUID SAMPLING APPARATUS AND METHOD FOR USE OF SAME

CROSS-REFERENCE TO RELATED APPLICATIONS

This is a continuation application of co-pending application Ser. No. 11/438,764 entitled Single Phase Fluid Sampling Apparatus and Method for Use of Same, filed on May 23, 2006, which is a continuation-in-part application of application Ser. No. 11/268,311, entitled Single Phase Fluid Sampler Systems and Associated Methods, filed on Nov. 7, 2005, now U.S. Pat. No. 7,197,923 B1, issued Apr. 3, 2007.

TECHNICAL FIELD OF THE INVENTION

This invention relates, in general, to testing and evaluation of subterranean formation fluids and, in particular to, a single phase fluid sampling apparatus for obtaining multiple fluid samples and maintaining the samples near reservoir pressure via a common pressure source during retrieval from the wellbore and storage on the surface.

BACKGROUND OF THE INVENTION

Without limiting the scope of the present invention, its background is described with reference to testing hydrocarbon formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure and bubble point may be determined. These and other characteristics of the formation and fluid contained therein may be determined by performing tests on the formation before the well is completed.

One type of testing procedure that is commonly performed is to obtain a fluid sample from the formation to, among other things, determine the composition of the formation fluids. In this procedure, it is important to obtain a sample of the formation fluid that is representative of the fluids as they exist in the formation. In a typical sampling procedure, a sample of the formation fluids may be obtained by lowering a sampling tool having a sampling chamber into the wellbore on a conveyance such as a wireline, slick line, coiled tubing, jointed tubing or the like. When the sampling tool reaches the desired depth, one or more ports are opened to allow collection of the formation fluids. The ports may be actuated in variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

It has been found, however, that as the fluid sample is retrieved to the surface, the temperature of the fluid sample decreases causing shrinkage of the fluid sample and a reduction in the pressure of the fluid sample. These changes can cause the fluid sample to approach or reach saturation pressure creating the possibility of asphaltene deposition and flashing of entrained gasses present in the fluid sample. Once such a process occurs, the resulting fluid sample is no longer representative of the fluids present in the formation. Therefore, a need has arisen for an apparatus and method for obtaining a fluid sample from a formation without degradation of the sample during retrieval of the sampling tool from the wellbore. A need has also arisen for such an apparatus and method that are capable of maintaining the integrity of the fluid sample during storage on the surface.

SUMMARY OF THE INVENTION

The present invention disclosed herein provides a single phase fluid sampling apparatus and a method for obtaining a fluid sample from a formation without the occurrence of phase change degradation of the fluid sample during the collection of the fluid sample or retrieval of the sampling apparatus from the wellbore. In addition, the sampling apparatus and method of the present invention are capable of maintaining the integrity of the fluid sample during storage on the surface.

In one aspect, the present invention is directed to an apparatus for obtaining a plurality of fluid samples in a subterranean well that includes a carrier, a plurality of sampling chambers and a pressure source. In one embodiment, the pressure source is selectively in fluid communication with at least two sampling chambers thereby serving as a common pressure source to pressurize fluid samples obtained in the at least two sampling chambers. In another embodiment, the carrier has a longitudinally extending internal fluid passageway forming a smooth bore and a plurality of externally disposed chamber receiving slots. Each of the sampling chambers is positioned in one of the chamber receiving slots of the carrier. The pressure source is selectively in fluid communication with each of the sampling chambers such that the pressure source is operable to pressurize each of the sampling chambers after the samples are obtained.

In one embodiment, the carrier has at least nine chamber receiving slots and nine sampling chambers are disposed within the chamber receiving slots. In this embodiment, a manifold provides the fluid communication between the sampling chambers and the pressure source such that the pressure source is operable to pressurize each of the nine sampling chambers. Also in this embodiment, the sampling chambers and the pressure source may be longitudinally separated by the manifold.

In one embodiment, the pressure source may include at least two pressure chambers. In this embodiment, each of the pressure chambers may be positioned in one of the chamber receiving slots of the carrier and each of the pressure chambers may be operable to pressurize at least two of the sampling chambers.

In another aspect, the present invention is directed to an apparatus for obtaining a plurality of fluid samples in a subterranean well that includes a carrier and a plurality of sampling chamber assemblies. The carrier has a longitudinally extending internal fluid passageway and a plurality of externally disposed chamber receiving slots. Each of the sampling chamber assemblies includes at least two sampling chambers and a pressure source and each of the sampling chambers and the pressure sources are positioned in one of the chamber receiving slots of the carrier. The sampling chambers of each sampling chamber assembly are selectively in fluid communication with the pressure source of that sampling chamber assembly such that the pressure source of each sampling chamber assembly is operable to pressurize each of the sampling chambers of that sampling chamber assembly.

In one embodiment, the plurality of sampling chamber assemblies includes three sampling chamber assemblies and each sampling chamber assembly includes two sampling chambers. In another embodiment, each of the sampling chamber assemblies includes a manifold that provides the fluid communication between the sampling chambers and the pressure source of each sampling chamber assembly.

In a further aspect, the present invention is directed to a method for obtaining a plurality of fluid samples in a subterranean well. The method includes the steps of positioning a fluid sampler in the well, obtaining a fluid sample in each of a plurality of sampling chambers of the fluid sampler and pressurizing each of the fluid samples using a pressure source of the fluid sampler that is in fluid communication with each of the sampling chambers.

In one embodiment, the step of obtaining a fluid sample in each of a plurality of sampling chambers of the fluid sampler includes simultaneously obtaining the fluid samples in at least two of the sampling chambers. In another embodiment, this step includes simultaneously obtaining the fluid samples in each of the sampling chambers. The method may further include the step of obtaining a first portion of each sample in a debris chamber. In addition, the method may include the steps of retrieving the fluid sampler to the surface and simultaneously supercharging at least two of the fluid samples using a surface pressure source.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
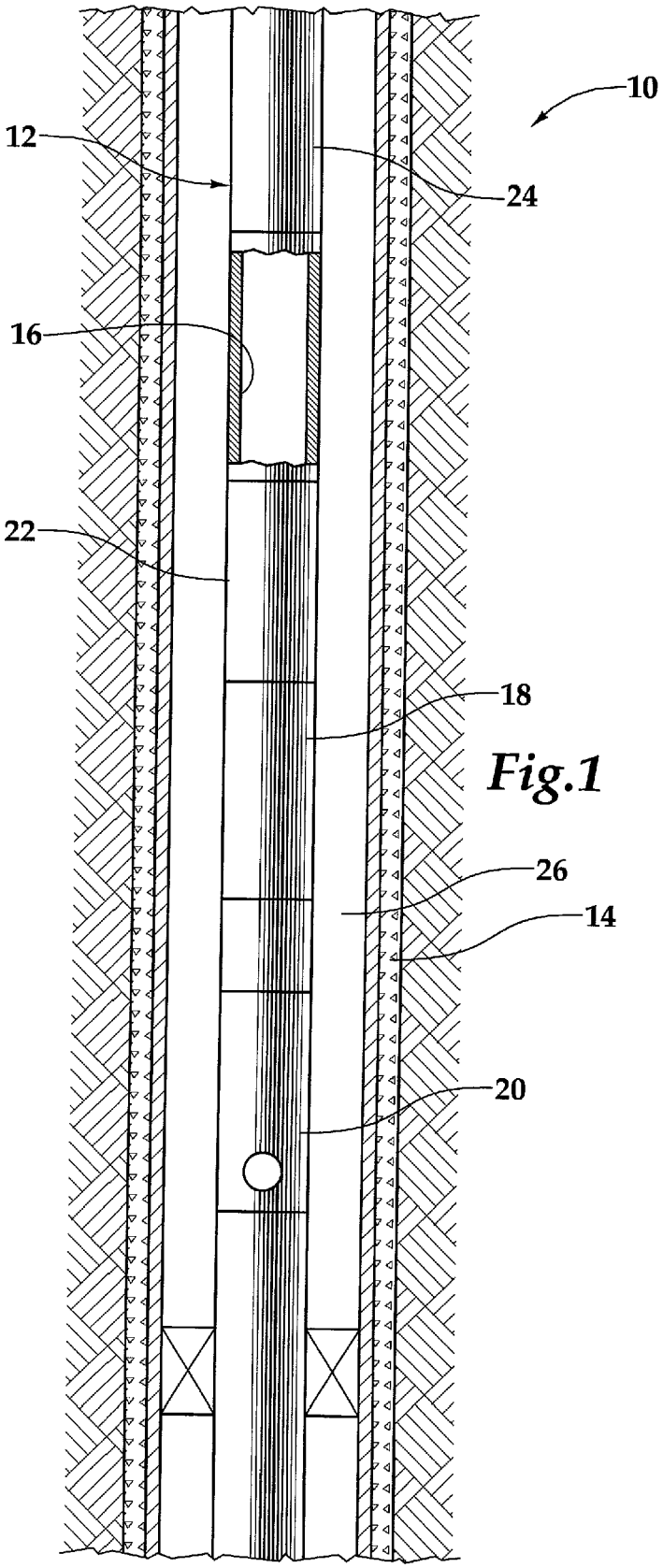
FIG. 1 is a schematic illustration of a fluid sampler system embodying principles of the present invention.
Figure 2A:
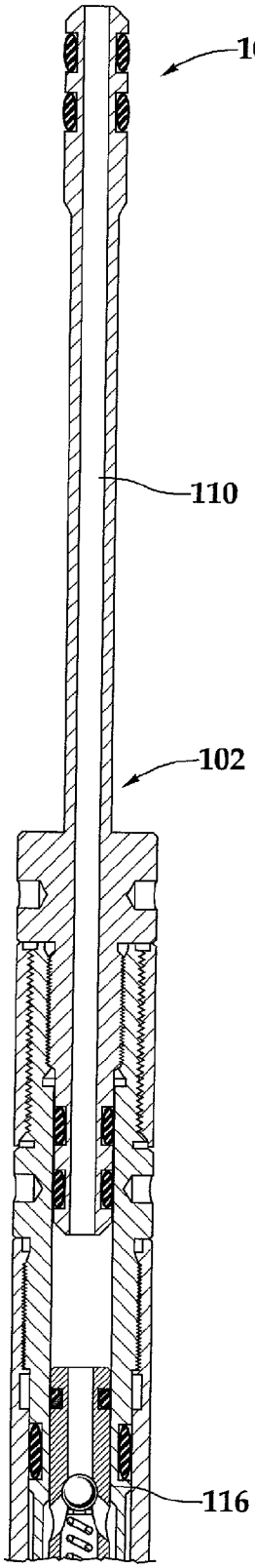
FIGS. 2A-H are cross-sectional views of successive axial portions of a sampling section of a sampler embodying principles of the present invention.
Figure 2B:
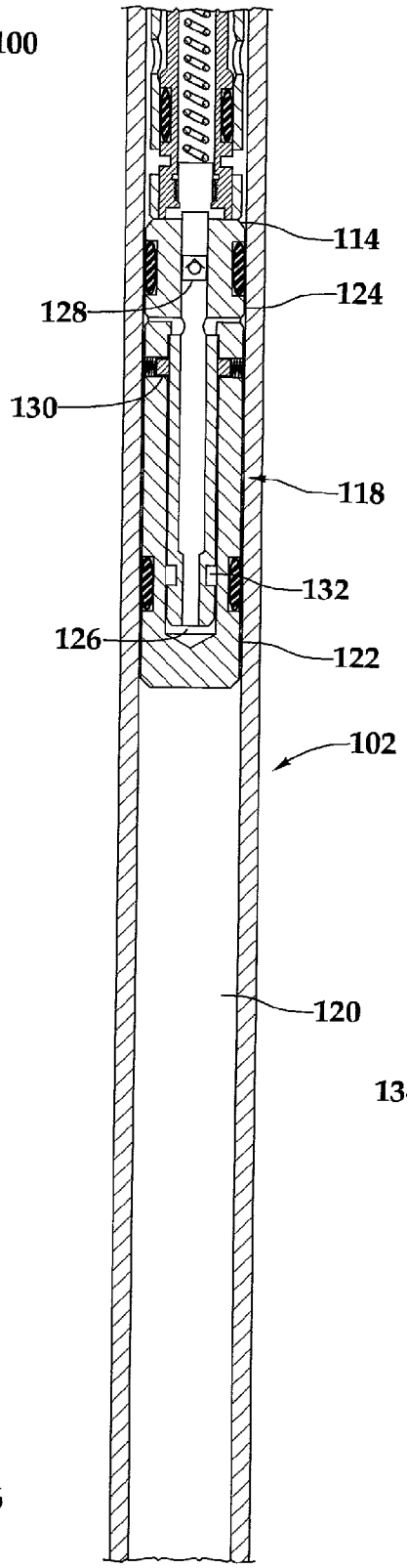
Figure 2C:
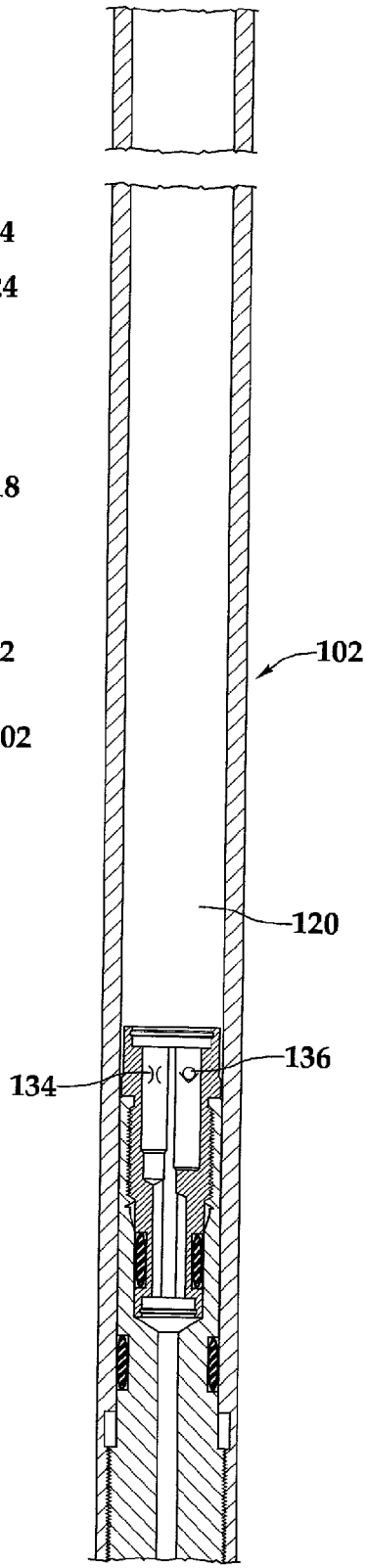
Figure 2D:
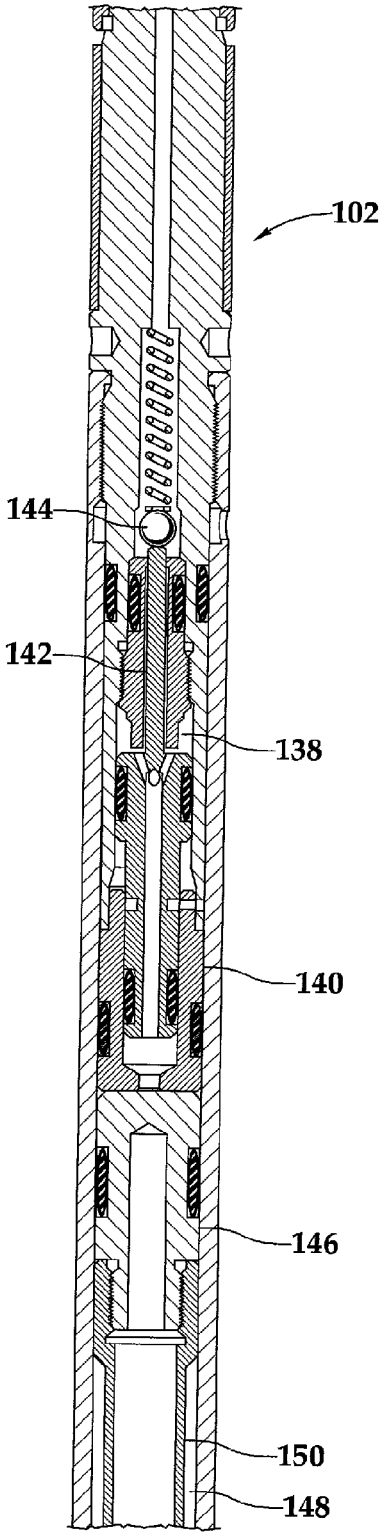
Figure 2E:
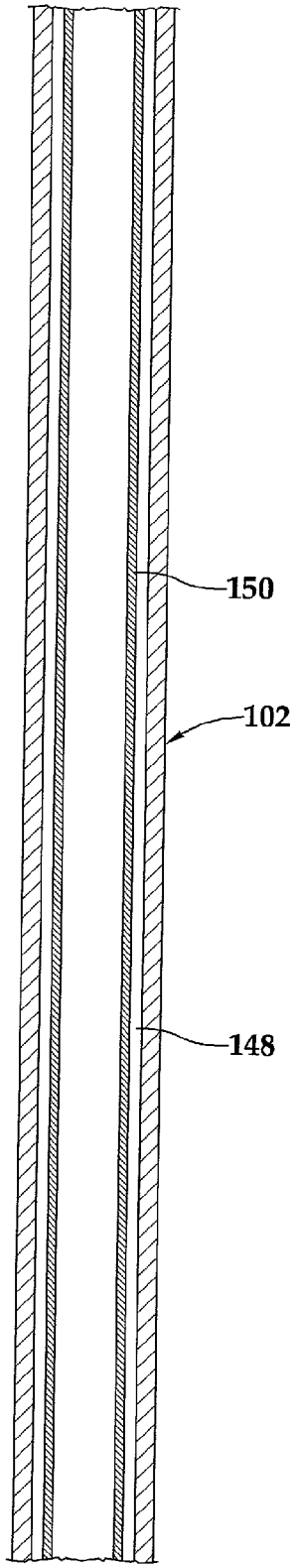
Figure 2F:
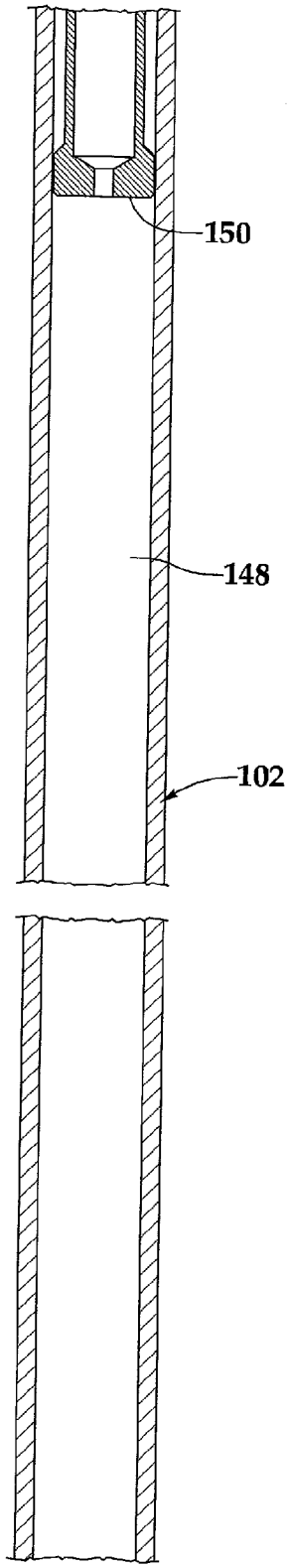
Figure 2G:
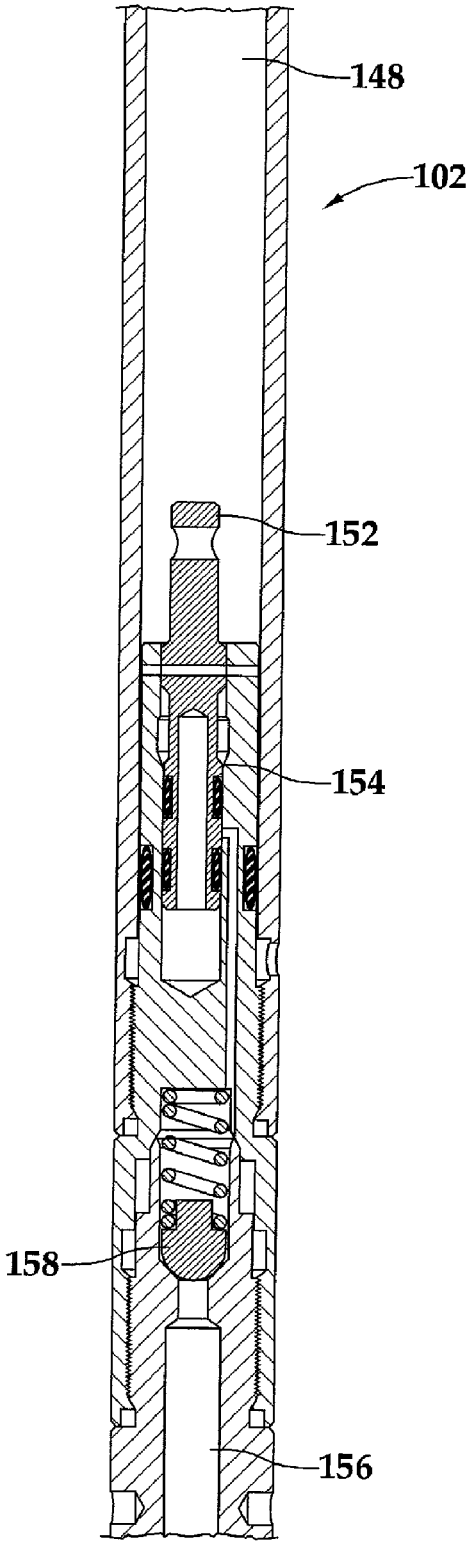
Figure 2H:
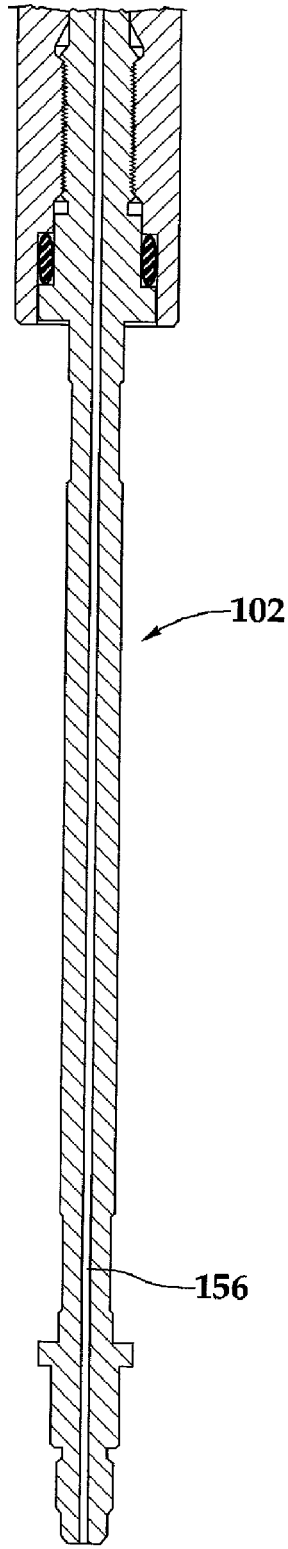

Referring initially to FIG. 1, therein is representatively illustrated a fluid sampler system 10 and associated methods which embody principles of the present invention. A tubular string 12, such as a drill stem test string, is positioned in a wellbore 14. An internal flow passage 16 extends longitudinally through tubular string 12.

A fluid sampler 18 is interconnected in tubular string 12. Also, preferably included in tubular string 12 are a circulating valve 20, a tester valve 22 and a choke 24. Circulating valve 20, tester valve 22 and choke 24 may be of conventional design. It should be noted, however, by those skilled in the art that it is not necessary for tubular string 12 to include the specific combination or arrangement of equipment described herein. It is also not necessary for sampler 18 to be included in tubular string 12 since, for example, sampler 18 could instead be conveyed through flow passage 16 using a wireline, slickline, coiled tubing, downhole robot or the like. Although wellbore 14 is depicted as being cased and cemented, it could alternatively be uncased or open hole.

In a formation testing operation, tester valve 22 is used to selectively permit and prevent flow through passage 16. Circulating valve 20 is used to selectively permit and prevent flow between passage 16 and an annulus 26 formed radially between tubular string 12 and wellbore 14. Choke 24 is used to selectively restrict flow through tubular string 12. Each of valves 20, 22 and choke 24 may be operated by manipulating pressure in annulus 26 from the surface, or any of them could be operated by other methods if desired.

Choke 24 may be actuated to restrict flow through passage 16 to minimize wellbore storage effects due to the large volume in tubular string 12 above sampler 18. When choke 24 restricts flow through passage 16, a pressure differential is created in passage 16, thereby maintaining pressure in passage 16 at sampler 18 and reducing the drawdown effect of opening tester valve 22. In this manner, by restricting flow through choke 24 at the time a fluid sample is taken in sampler 18, the fluid sample may be prevented from going below its bubble point, i.e., the pressure below which a gas phase begins to form in a fluid phase. Circulating valve 20 permits hydrocarbons in tubular string 12 to be circulated out prior to retrieving tubular string 12. As described more fully below, circulating valve 20 also allows increased weight fluid to be circulated into wellbore 14.

Even though FIG. 1 depicts a vertical well, it should be noted by one skilled in the art that the fluid sampler of the present invention is equally well-suited for use in deviated wells, inclined wells or horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Referring now to FIGS. 2A-2H and 3A-3E, a fluid sampler including an exemplary fluid sampling chamber and an exemplary carrier having a pressure source coupled thereto for use in obtaining a plurality of fluid samples that embodies principles of the present invention is representatively illustrated and generally designated 100. Fluid sampler 100 includes a plurality of the sampling chambers such sampling chamber 102 as depicted in FIG. 2. Each of the sampling chambers 102 is coupled to a carrier 104 that also includes an actuator 106 and a pressure source 108 as depicted in FIG. 3.

As described more fully below, a passage 110 in an upper portion of sampling chamber 102 (see FIG. 2A) is placed in communication with a longitudinally extending internal fluid passageway 112 formed completely through fluid sampler 100 (see FIG. 3) when the fluid sampling operation is initiated using actuator 106. Passage 112 becomes a portion of passage 16 in tubular string 12 (see FIG. 1) when fluid sampler 100 is interconnected in tubular string 12. As such, internal fluid passageway 112 provides a smooth bore through fluid sampler 100. Passage 110 in the upper portion of sampling chamber 102 is in communication with a sample chamber 114 via a check valve 116. Check valve 116 permits fluid to flow from passage 110 into sample chamber 114, but prevents fluid from escaping from sample chamber 114 to passage 110.

A debris trap piston 118 separates sample chamber 114 from a meter fluid chamber 120. When a fluid sample is received in sample chamber 114, piston 118 is displaced downwardly. Prior to such downward displacement of piston 118, however, piston section 122 is displaced downwardly relative to piston section 124. In the illustrated embodiment, as fluid flows into sample chamber 114, an optional check valve 128 permits the fluid to flow into debris chamber 126. The resulting pressure differential across piston section 122 causes piston section 122 to displace downward, thereby expanding debris chamber 126.

Eventually, piston section 122 will displace downward sufficiently far for a snap ring, C-ring, spring-loaded lugs, dogs or other type of engagement device 130 to engage a recess 132 formed on piston section 124. Once engagement device 130 has engaged recess 132, piston sections 122, 124 displace downwardly together to expand sample chamber 114. The fluid received in debris chamber 126 is prevented from escaping back into sample chamber 114 by check valve 128 in embodiments that include check valve 128. In this manner, the fluid initially received into sample chamber 114 is trapped in debris chamber 126. This initially received fluid is typically laden with debris, or is a type of fluid (such as mud) which it is not desired to sample. Debris chamber 126 thus permits this initially received fluid to be isolated from the fluid sample later received in sample chamber 114.

Meter fluid chamber 120 initially contains a metering fluid, such as a hydraulic fluid, silicone oil or the like. A flow restrictor 134 and a check valve 136 control flow between chamber 120 and an atmospheric chamber 138 that initially contains a gas at a relatively low pressure such as air at atmospheric pressure. A collapsible piston assembly 140 in chamber 138 includes a prong 142 which initially maintains another check valve 144 off seat, so that flow in both directions is permitted through check valve 144 between chambers 120, 138. When elevated pressure is applied to chamber 138, however, as described more fully below, piston assembly 140 collapses axially, and prong 142 will no longer maintain check valve 144 off seat, thereby preventing flow from chamber 120 to chamber 138.

A floating piston 146 separates chamber 138 from another atmospheric chamber 148 that initially contains a gas at a relatively low pressure such as air at atmospheric pressure. A spacer 150 is attached to piston 146 and limits downward displacement of piston 146. Spacer 150 is also used to contact a stem 152 of a valve 154 to open valve 154. Valve 154 initially prevents communication between chamber 148 and a passage 156 in a lower portion of sampling chamber 102. In addition, a check valve 158 permits fluid flow from passage 156 to chamber 148, but prevents fluid flow from chamber 148 to passage 156.

As mentioned above, one or more of the sampling chambers 102 and preferably nine of sampling chambers 102 are installed within exteriorly disposed chamber receiving slots 159 that circumscribe internal fluid passageway 112 of carrier 104. A seal bore 160 (see FIG. 3B) is provided in carrier 104 for receiving the upper portion of sampling chamber 102 and another seal bore 162 (see FIG. 3C) is provided for receiving the lower portion of sampling chamber 102. In this manner, passage 110 in the upper portion of sampling chamber 102 is placed in sealed communication with a passage 164 in carrier 104, and passage 156 in the lower portion of sampling chamber 102 is placed in sealed communication with a passage 166 in carrier 104.

In addition to the nine sampling chambers 102 installed within carrier 104, a pressure and temperature gauge/recorder (not shown) of the type known to those skilled in the art can also be received in carrier 104 in a similar manner. For example, seal bores 168, 170 in carrier 104 may be for providing communication between the gauge/recorder and internal fluid passageway 112. Note that, although seal bore 170 depicted in FIG. 3C is in communication with passage 172, preferably if seal bore 170 is used to accommodate a gauge/recorder, then a plug is used to isolate the gauge/recorder from passage 172. Passage 172 is, however, in communication with passage 166 and the lower portion of each sampling chamber 102 installed in a seal bore 162 and thus servers as a manifold for fluid sampler 100. If a sampling chamber 102 or gauge/recorder is not installed in one or more of the seal bores 160, 162, 168, 170 then a plug will be installed to prevent flow therethrough.

Passage 172 is in communication with chamber 174 of pressure source 108. Chamber 174 is in communication with chamber 176 of pressure source 108 via a passage 178. Chambers 174, 176 initially contain a pressurized fluid, such as a compressed gas or liquid. Preferably, compressed nitrogen at between about 7,000 psi and 12,000 psi is used to precharge chambers 174, 176, but other fluids or combinations of fluids and/or other pressures both higher and lower could be used, if desired. Even though FIG. 3 depicts pressure source 108 as having two compressed fluid chambers 174, 176, it should be understood by those skilled in the art that pressure source 108 could have any number of chambers both higher and lower than two that are in communication with one another to provide the required pressure source. As best seen in FIG. 4, a cross-sectional view of pressure source 108 is illustrated, showing a fill valve 180 and a passage 182 extending from fill valve 180 to chamber 174 for supplying the pressurized fluid to chambers 174, 176 at the surface prior to running fluid sampler 100 downhole.

Figure 3A:
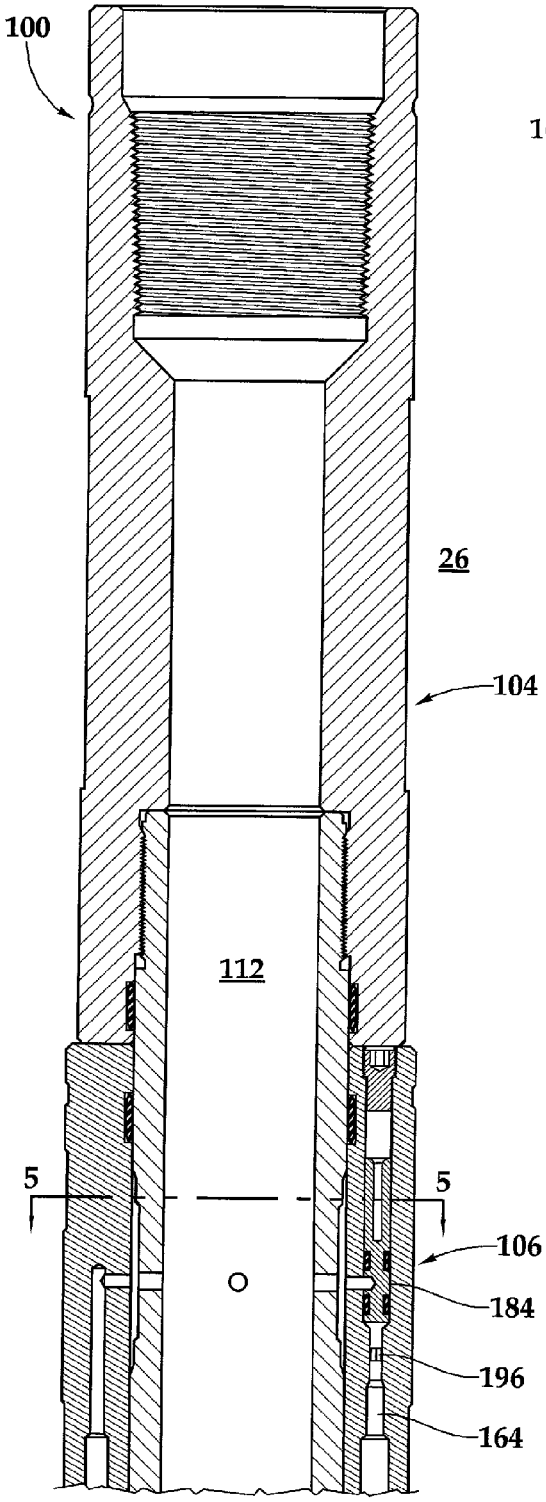
FIGS. 3A-E are cross-sectional views of successive axial portions of actuator, carrier and pressure source sections of a sampler embodying principles of the present invention.
Figure 3B:
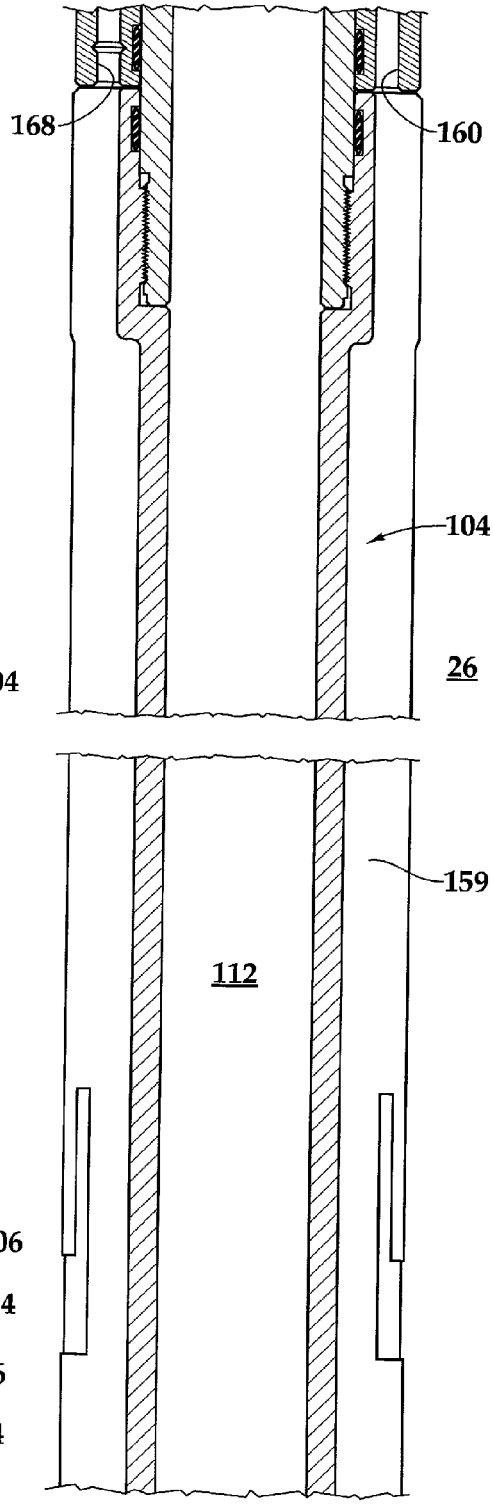
Figure 3C:
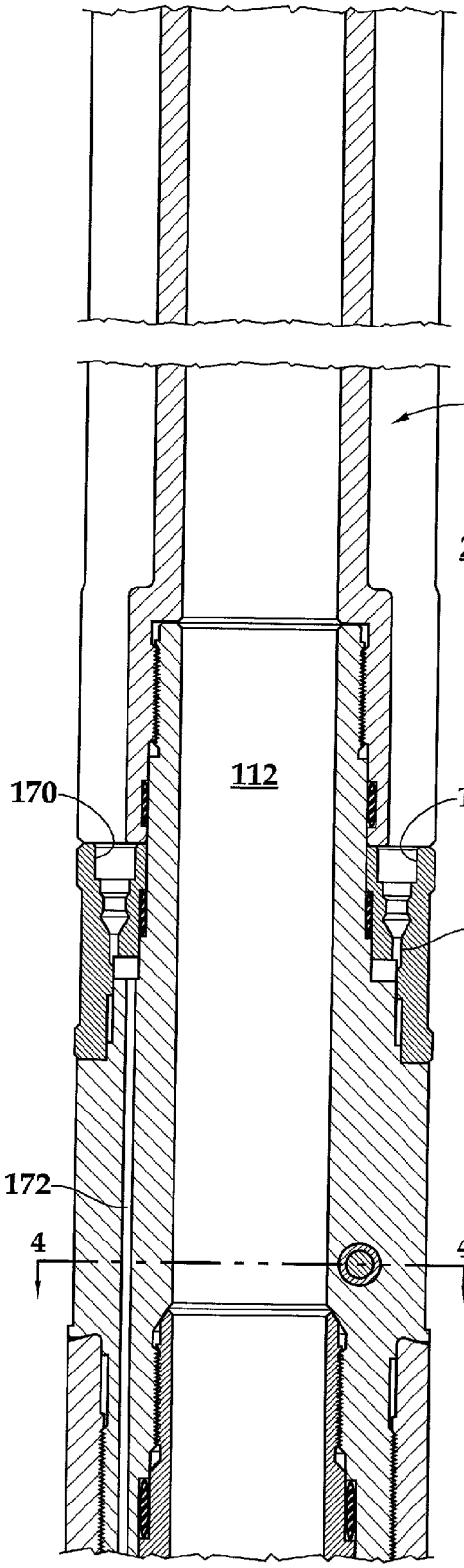
Figure 3D:
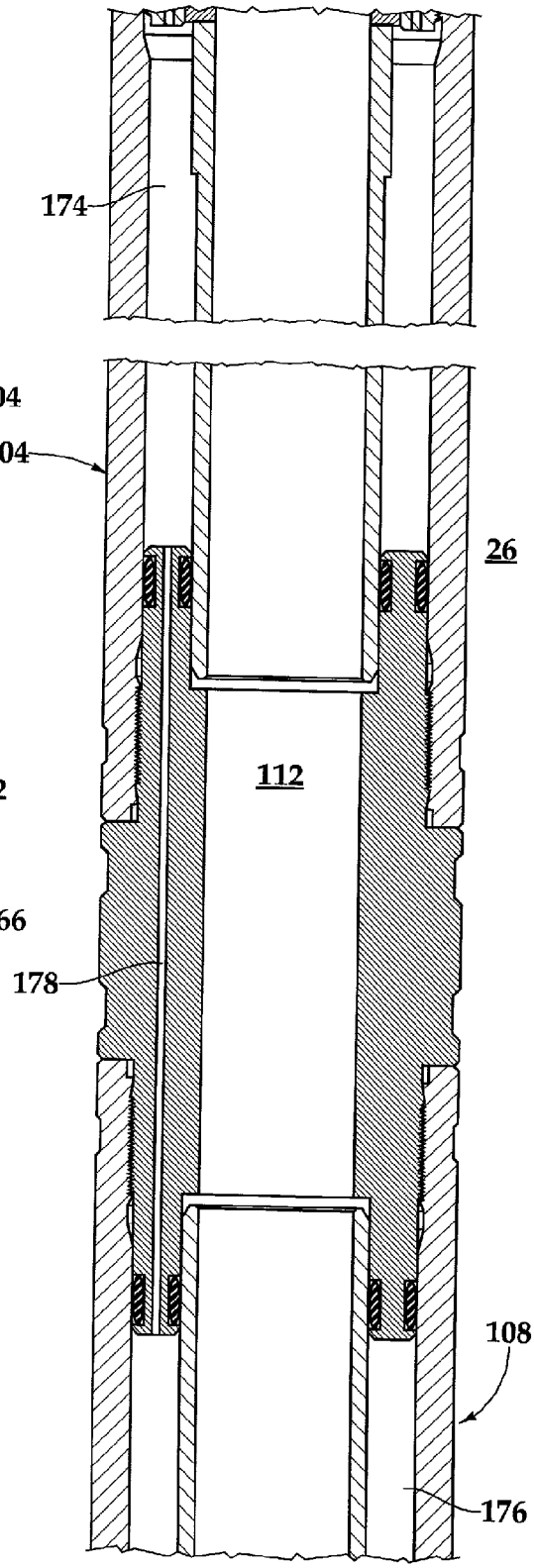
Figure 3E:
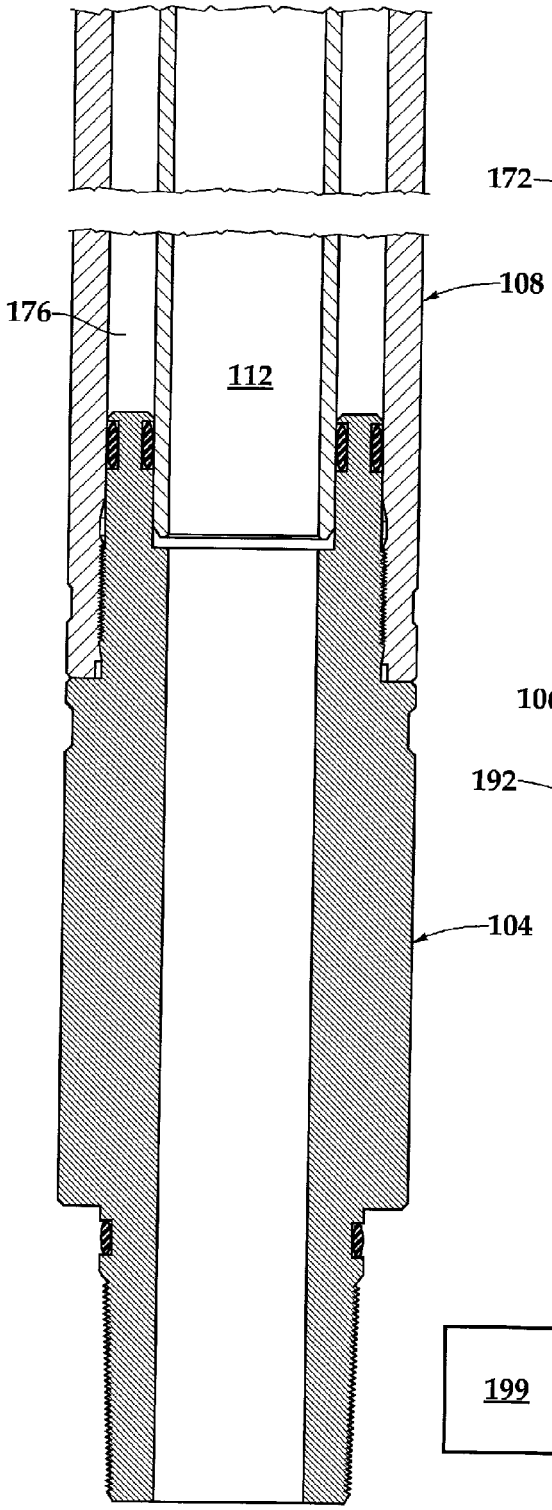
Figure 4:
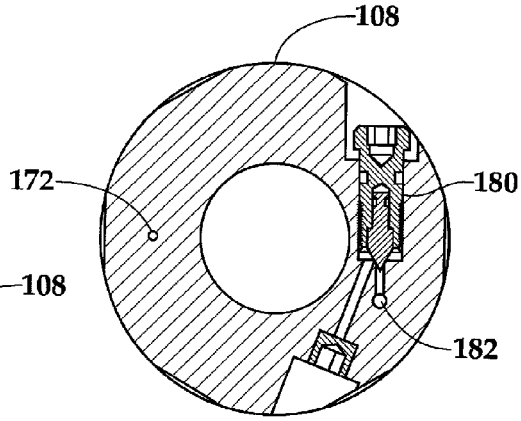
FIG. 4 is a cross-sectional view of the pressure source section of FIG. 3C taken along line 4-4.
Figure 5:
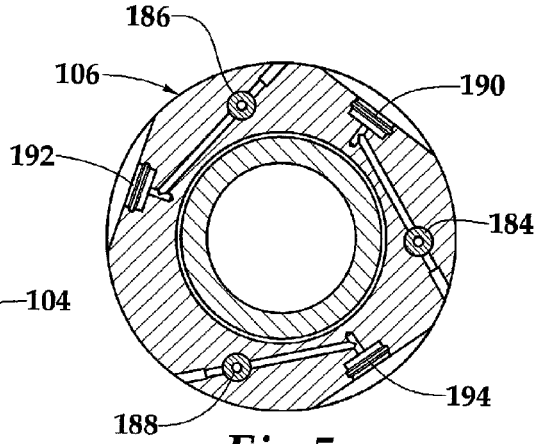
FIG. 5 is a cross-sectional view of the actuator section of FIG. 3A taken along line 5-5.

As best seen in FIGS. 3A and 5, actuator 106 includes multiple valves 184, 186, 188 and respective multiple rupture disks 190, 192, 194 to provide for separate actuation of multiple groups of sampling chambers 102. In the illustrated embodiment, nine sampling chambers 102 may be used, and these are divided up into three groups of three sampling chambers each. Each group of sampling chambers can be referred to as a sampling chamber assembly. Thus, a valve 184, 186, 188 and a respective rupture disk 190, 192, 194 are used to actuate a group of three sampling chambers 102. For clarity, operation of actuator 106 with respect to only one of the valves 184, 186, 188 and its respective one of the rupture disks 190, 192, 194 is described below. Operation of actuator 106 with respect to the other valves and rupture disks is similar to that described below.

Valve 184 initially isolates passage 164, which is in communication with passages 110 in three of the sampling chambers 102 via passage 196, from internal fluid passage 112 of fluid sampler 100. This isolates sample chamber 114 in each of the three sampling chambers 102 from passage 112. When it is desired to receive a fluid sample into each of the sample chambers 114 of the three sampling chambers 102, pressure in annulus 26 is increased a sufficient amount to rupture the disk 190. This permits pressure in annulus 26 to shift valve 184 upward, thereby opening valve 184 and permitting communication between passage 112 and passages 196, 164.

Fluid from passage 112 then enters passage 110 in the upper portion of each of the three sampling chambers 102.

For clarity, the operation of only one of the sampling chambers 102 after receipt of a fluid sample therein is described below. The fluid flows from passage 110 through check valve 116 to sample chamber 114. An initial volume of the fluid is trapped in debris chamber 126 of piston 118 as described above. Downward displacement of the piston section 122, and then the combined piston sections 122, 124, is slowed by the metering fluid in chamber 120 flowing through restrictor 134. This prevents pressure in the fluid sample received in sample chamber 114 from dropping below its bubble point.

As piston 118 displaces downward, the metering fluid in chamber 120 flows through restrictor 134 into chamber 138. At this point, prong 142 maintains check valve 144 off seat. The metering fluid received in chamber 138 causes piston 146 to displace downward. Eventually, spacer 150 contacts stem 152 of valve 154 which opens valve 154. Opening of valve 154 permits pressure in pressure source 108 to be applied to chamber 148. Pressurization of chamber 148 also results in pressure being applied to chambers 138, 120 and thus to sample chamber 114. This is due to the fact that passage 156 is in communication with passages 166, 172 (see FIG. 3C) and, thus, is in communication with the pressurized fluid from pressure source 108.

When the pressure from pressure source 108 is applied to chamber 138, piston assembly 140 collapses and prong 142 no longer maintains check valve 144 off seat. Check valve 144 then prevents pressure from escaping from chamber 120 and sample chamber 114. Check valve 116 also prevents escape of pressure from sample chamber 114. In this manner, the fluid sample received in sample chamber 114 is pressurized.

In the illustrated embodiment of fluid sampler 100, multiple sampling chambers 102 are actuated by rupturing disk 190, since valve 184 is used to provide selective communication between passage 112 and passages 110 in the upper portions of multiple sampling chambers 102. Thus, multiple sampling chambers 102 simultaneously receive fluid samples therein from passage 112.

In a similar manner, when rupture disk 192 is ruptured, an additional group of multiple sampling chambers 102 will receive fluid samples therein, and when the rupture disk 194 is ruptured a further group of multiple sampling chambers 102 will receive fluid samples therein. Rupture disks 184, 186, 188 may be selected so that they are ruptured sequentially at different pressures in annulus 26 or they may be selected so that they are ruptured simultaneously, at the same pressure in annulus 26.

Another important feature of fluid sampler 100 is that the multiple sampling chambers 102, nine in the illustrated example, share the same pressure source 108. That is, pressure source 108 is in communication with each of the multiple sampling chambers 102. This feature provides enhanced convenience, speed, economy and safety in the fluid sampling operation. In addition to sharing a common pressure source downhole, the multiple sampling chambers 102 of fluid sampler 100 can also share a common pressure source on the surface. Specifically, once all the samples are obtained and pressurized downhole, fluid sampler 100 is retrieved to the surface. Even though certain cooling of the samples will take place, the common pressure source maintains the samples at a suitable pressure to prevent any phase change degradation. Once on the surface, the sample may remain in the multiple sampling chambers 102 for a considerable time during which temperature conditions may fluctuate. Accordingly, a surface pressure source, such a compressor or a pump, may be used to supercharge the sampling chambers 102. This supercharging process allows multiple sampling chambers 102 to be further pressurized at the same time with sampling chambers 102 remaining in carrier 104 or after sampling chambers 102 have been removed from carrier 104.

Note that, although actuator 106 is described above as being configured to permit separate actuation of three groups of sampling chambers 102, with each group including three of the sampling chambers 102, it will be appreciated that any number of sampling chambers 102 may be used, sampling chambers 102 may be included in any number of groups (including one), each group could include any number of sampling chambers 102 (including one), different groups can include different numbers of sampling chambers 102 and it is not necessary for sampling chambers 102 to be separately grouped at all.

Figure 6:
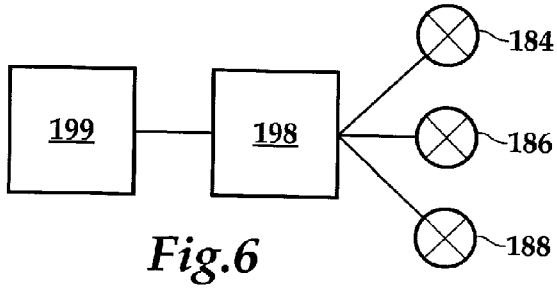
FIG. 6 is a schematic view of an alternate actuating method for a sampler embodying principles of the present invention.

Referring now to FIG. 6, an alternate actuating method for fluid sampler 100 is representatively and schematically illustrated. Instead of using increased pressure in annulus 26 to actuate valves 184, 186, 188, a control module 198 included in fluid sampler 100 may be used to actuate valves 184, 186, 188. For example, a telemetry receiver 199 may be connected to control module 198. Receiver 199 may be any type of telemetry receiver, such as a receiver capable of receiving acoustic signals, pressure pulse signals, electromagnetic signals, mechanical signals or the like. As such, any type of telemetry may be used to transmit signals to receiver 199.

When control module 198 determines that an appropriate signal has been received by receiver 199, control module 198 causes a selected one or more of valves 184, 186, 188 to open, thereby causing a plurality of fluid samples to be taken in fluid sampler 100. Valves 184, 186, 188 may be configured to open in response to application or release of electrical current, fluid pressure, biasing force, temperature or the like.

Figure 7:
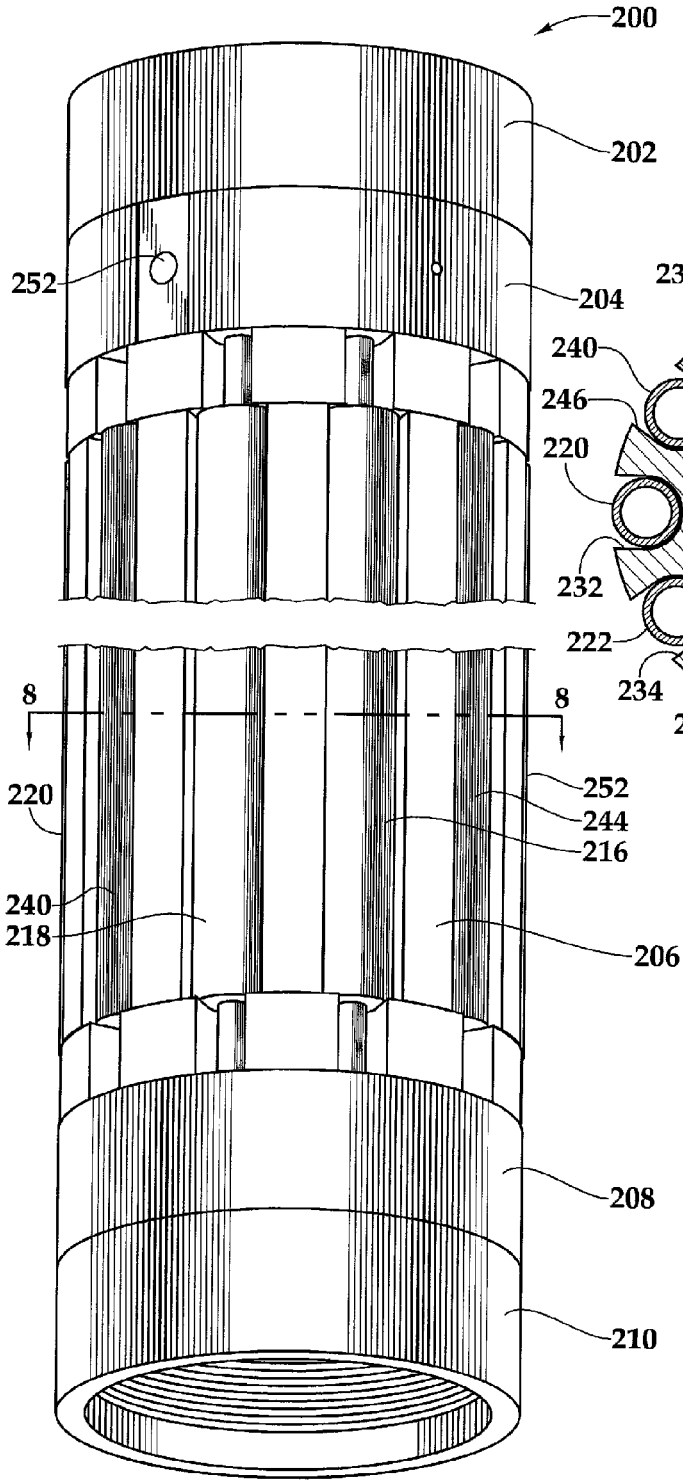
FIG. 7 is a schematic illustration of an alternate embodiment of a fluid sampler embodying principles of the present invention.
Figure 8:
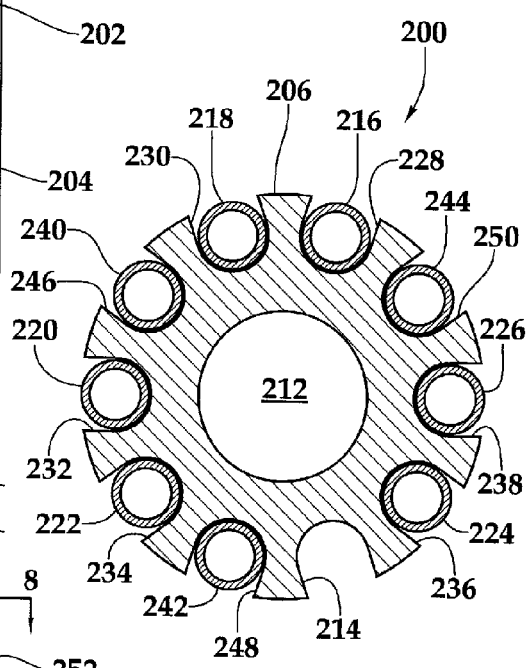
FIG. 8 is a cross-sectional view of the fluid sampler of FIG. 7 taken along line 8-8.

Referring now to FIGS. 7 and 8, an alternate embodiment of a fluid sampler for use in obtaining a plurality of fluid samples that embodies principles of the present invention is representatively illustrated and generally designated 200. Fluid sampler 200 includes an upper connector 202 for coupling fluid sampler 200 to other well tools in the sampler string. Fluid sampler 200 also includes an actuator 204 that operates in a manner similar to actuator 106 described above. Below actuator 204 is a carrier 206 that is of similar construction as carrier 104 described above. Fluid sampler 200 further includes a manifold 208 for distributing fluid pressure. Below manifold 208 is a lower connector 210 for coupling fluid sampler 200 to other well tools in the sampler string.

Fluid sampler 200 has a longitudinally extending internal fluid passageway 212 formed completely through fluid sampler 200. Passageway 212 becomes a portion of passage 16 in tubular string 12 (see FIG. 1) when fluid sampler 200 is interconnected in tubular string 12. In the illustrated embodiment, carrier 206 has ten exteriorly disposed chamber receiving slots that circumscribe internal fluid passageway 212. As mentioned above, a pressure and temperature gauge/recorder (not shown) of the type known to those skilled in the art can be received in carrier 206 within one of the chamber receiving slots such as slot 214. The remainder of the slots are used to receive sampling chambers and pressure source chambers.

In the illustrated embodiment, sampling chambers 216, 218, 220, 222, 224, 226 are respectively received within slots 228, 230, 232, 234, 236, 238. Sampling chambers 216, 218, 220, 222, 224, 226 are of a construction and operate in the manner described above with reference to sampling chamber 102. Pressure source chambers 240, 242, 244 are respectively received within slots 246, 248, 250 in a manner similar to that described above with reference to sampling chamber 102. Pressure source chambers 240, 242, 244 initially contain a pressurized fluid, such as a compressed gas or liquid. Preferably, compressed nitrogen at between about 10,000 psi and 20,000 psi is used to precharge chambers 240, 242, 244, but other fluids or combinations of fluids and/or other pressures both higher and lower could be used, if desired.

Actuator 204 includes three valves that operate in a manner similar to valves 184, 186, 188 of actuator 106. Actuator 204 has three rupture disks, one associated with each valve in a manner similar to rupture disks 190, 192, 194 of actuator 106 and one of which is pictured and denoted as rupture disk 252. As described above, each of the rupture disks provides for separate actuation of a group of sampling chambers. In the illustrated embodiment, six sampling chambers are used, and these are divided up into three groups of two sampling chambers each. Associated with each group of two sampling chambers is one pressure source chamber. Specifically, rupture disk 252 is associated with sampling chambers 216, 218 which are also associated with pressure source chamber 240 via manifold 208. In a like manner, the second rupture disk is associated with sampling chambers 220, 222 which are also associated with pressure source chamber 242 via manifold 208. In addition, the third rupture disk is associated with sampling chambers 224, 226 which are also associated with pressure source chamber 244 via manifold 208. In the illustrated embodiment, each rupture disk, valve, pair of sampling chambers, pressure source chamber and manifold section can be referred to as a sampling chamber assembly. Each of the three sampling chamber assemblies operates independently of the other two sampling chamber assemblies. For clarity, the operation of one sampling chamber assembly is described below. Operation of the other two sampling chamber assemblies is similar to that described below.

The valve associated with rupture disk 252 initially isolates the sample chambers of sampling chambers 216, 218 from internal fluid passageway 212 of fluid sampler 200. When it is desired to receive a fluid sample into each of the sample chambers of sampling chambers 216, 218, pressure in annulus 26 is increased a sufficient amount to rupture the disk 252. This permits pressure in annulus 26 to shift the associated valve upward in a manner described above, thereby opening the valve and permitting communication between passageway 212 and the sample chambers of sampling chambers 216, 218.

As described above, fluid from passageway 212 enters a passage in the upper portion of each of the sampling chambers 216, 218 and passes through an optional check valve to the sample chambers. An initial volume of the fluid is trapped in a debris chamber as described above. Downward displacement of the debris piston is slowed by the metering fluid in another chamber flowing through a restrictor. This prevents pressure in the fluid sample received in the sample chambers from dropping below its bubble point.

As the debris piston displaces downward, the metering fluid flows through the restrictor into a lower chamber causing a piston to displace downward. Eventually, a spacer contacts a stem of a lower valve which opens the valve and permits pressure from pressure source chamber 240 to be applied to the lower chamber via manifold 208. Pressurization of the lower chamber also results in pressure being applied to the sample chambers of sampling chambers 216, 218.

As described above, when the pressure from pressure source chamber 240 is applied to the lower chamber, a piston assembly collapses and a prong no longer maintains a check valve off seat, which prevents pressure from escaping from the sample chambers. The upper check valve also prevents escape of pressure from the sample chamber. In this manner, the fluid samples received in the sample chambers are pressurized.

In the illustrated embodiment of fluid sampler 200, two sampling chambers 216, 218 are actuated by rupturing disk 252, since the valve associated therewith is used to provide selective communication between passageway 212 the sample chambers of sampling chambers 216, 218. Thus, both sampling chambers 216, 218 simultaneously receive fluid samples therein from passageway 212.

In a similar manner, when the other rupture disks are ruptured, additional groups of two sampling chambers (sampling chambers 220, 222 and sampling chambers 224, 226) will receive fluid samples therein and the fluid samples obtained therein will be pressurize by pressure sources 242, 244, respectively. The rupture disks may be selected so that they are ruptured sequentially at different pressures in annulus 26 or they may be selected so that they are ruptured simultaneously, at the same pressure in annulus 26.

One of the important features of fluid sampler 200 is that the multiple sampling chambers, two in the illustrated example, share a common pressure source. That is, each pressure source is in communication with multiple sampling chambers. This feature provides enhanced convenience, speed, economy and safety in the fluid sampling operation. In addition to sharing a common pressure source downhole, multiple sampling chambers of fluid sampler 200 can also share a common pressure source on the surface. Specifically, once all the samples are obtained and pressurized downhole, fluid sampler 200 is retrieved to the surface. Even though certain cooling of the samples will take place, the common pressure source maintains the samples at a suitable pressure to prevent any phase change degradation. Once on the surface, the samples may remain in the multiple sampling chambers for a considerable time during which temperature conditions may fluctuate. Accordingly, a surface pressure source, such a compressor or a pump, may be used to supercharge the sampling chambers. This supercharging process allows multiple sampling chambers to be further pressurized at the same time with the sampling chambers remaining in carrier 206 or after sampling chambers have been removed from carrier 206.

It should be understood by those skilled in the art that even though fluid sampler 200 has been described as having one pressure source chamber in communication with two sampling chambers via manifold 208, other numbers of pressure source chambers may be in communication with other numbers of sampling chambers with departing from the principles of the present invention. For example, in certain embodiments, one pressure source chamber could communicate pressure to three, four or more sampling chambers. Likewise, two or more pressure source chambers could act as a common pressure source to a single sampling chamber or to a plurality of sampling chambers. Each of these embodiments may be enabled by making the appropriate adjustments to manifold 208 such that the desired pressure source chambers and the desired sampling chambers are properly communicated to one another.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for obtaining a plurality of fluid samples in a subterranean well comprising:

a carrier having a longitudinally extending internal fluid passageway providing a substantially smooth bore therethrough;

a plurality of sampling chambers coupled to the carrier, each of the sampling chambers operable to obtain a fluid sample; and a pressure source of the apparatus including a plurality of self contained pressure source chambers, the pressure source selectively in fluid communication with the sampling chambers such that the pressure source is operable to pressurize fluid samples obtained in the sampling chambers.

2. The apparatus as recited in claim 1 further comprises a manifold that provides the fluid communication between the sampling chambers and the pressure source.

3. The apparatus as recited in claim 1 wherein the pressure source further comprises a compressed fluid.

4. The apparatus as recited in claim 3 wherein the compressed fluid further comprises a compressed inert gas.

5. The apparatus as recited in claim 4 wherein the compressed inert gas further comprises nitrogen.

6. The apparatus as recited in claim 3 wherein the compressed fluid further comprises a combination of compressed fluids.

7. The apparatus as recited in claim 3 wherein the compressed fluid is pressurized to between about 10,000 psi and about 20,000 psi.

8. An apparatus for obtaining a plurality of fluid samples in a subterranean well comprising:

a carrier having a longitudinally extending internal fluid passageway providing a substantially smooth bore therethrough;

a plurality of sampling chambers coupled to the carrier, each of the sampling chambers operable to obtain a fluid sample; and a pressure source including a plurality of self contained pressure source chambers coupled to the carrier, the pressure source selectively in fluid communication with the sampling chambers such that the pressure source is operable to pressurize fluid samples obtained in the sampling chambers.

9. The apparatus as recited in claim 8 further comprises a manifold that provides the fluid communication between the sampling chambers and the pressure source.

10. The apparatus as recited in claim 8 wherein the pressure source further comprises a compressed fluid.

11. The apparatus as recited in claim 10 wherein the compressed fluid further comprises a compressed inert gas.

12. The apparatus as recited in claim 11 wherein the compressed inert gas further comprises nitrogen.

13. The apparatus as recited in claim 10 wherein the compressed fluid further comprises a combination of compressed fluids.

14. The apparatus as recited in claim 10 wherein the compressed fluid is pressurized to between about 10,000 psi and about 20,000 psi.

15. A method for obtaining a plurality of fluid samples in a subterranean well, the method comprising the steps of:

positioning a fluid sampler having a longitudinally extending internal fluid passageway providing a substantially smooth bore therethrough and a plurality of sampling chambers in the well;

obtaining a plurality of fluid samples in the sampling chambers; and pressurizing the fluid samples using a pressure source of the fluid sampler including a plurality of self contained pressure source chambers, the pressure source in fluid communication with the sampling chambers.

16. The method as recited in claim 15 further comprising obtaining a fluid sample in each of the sampling chambers and pressurizing fluid samples obtained in each of the sampling chambers.

17. The method as recited in claim 15 wherein pressurizing the fluid samples using a pressure source of the fluid sampler further comprises pressurizing the fluid samples using a compressed fluid pressure source.

18. The method as recited in claim 15 wherein pressurizing the fluid samples using a pressure source of the fluid sampler further comprises pressurizing the fluid samples using a compressed inert gas pressure source.

19. The method as recited in claim 15 wherein pressurizing the fluid samples using a pressure source of the fluid sampler further comprises pressurizing the fluid samples using a compressed nitrogen pressure source.

20. The method as recited in claim 15 wherein pressurizing the fluid samples using a pressure source of the fluid sampler further comprises pressurizing the fluid samples using a pressure source including a combination of compressed fluids.

21. The method as recited in claim 15 wherein pressurizing the fluid samples using a pressure source of the fluid sampler further comprises pressurizing the fluid samples using a pressure source pressurized to between about 10,000 psi and about 20,000 psi.

* * * * *